US006072139A

United States Patent [19]

Nakase et al.

[11] Patent Number: 6,072,139

[45] Date of Patent: Jun. 6, 2000

[54] LEVER SWITCH AND METHOD OF OPERATING THE SAME

[75] Inventors: Masaki Nakase; Yasuchika Kudo; Yusho Nakase, all of Fukui, Japan

[73] Assignee: Matsushita Electric Industrial Co., Ltd., Osaka, Japan

[21] Appl. No.: 09/267,283

[22] Filed: Mar. 12, 1999

[30] Foreign Application Priority Data

Mar. 12, 1998 [JP] Japan ..... 10-060866

[51] Int. Cl.[7] ..... H01H 21/82

[52] U.S. Cl. ..... 200/558; 200/553

[58] Field of Search ..... 200/339, 16 A, 200/16 D, 553, 559, 561, 557

[56] References Cited

U.S. PATENT DOCUMENTS 3,965,319 6/1976 Lockard ..... 200/310
4,628,166 12/1986 Bingo et al. ..... 200/302.1
4,926,012 5/1990 Pellerin de Beauvais .
5,053,592 10/1991 Zuercher .

*Primary Examiner*—Michael L. Gellner
*Assistant Examiner*—Nhung Nguyen
*Attorney, Agent, or Firm*—Ratner & Prestia

[57] ABSTRACT

A lever switch comprises a box-shaped case 11 with the top open having fixed contact points 12, 13, 14 on the inner bottom surface. A movable contact element 15 made of an elastic metal, formed into an approximately reverse isosceles triangle having an elastic contact point 15E, 15F provided at the tip end of two respective elastic feet 15C, 15D extended from the equilateral sides to be crossing downward is placed in the case. An actuating body 16 of approximately isosceles triangle shape is disposed on the top of the movable contact element 15 so as protrusions 16C, 16D provided at the bottom corners press the upper surface of the flexed portions 15A, 15B, respectively, locating at the upper corners of the movable contact element 15. The operation lever 16E of actuating body 16 operates smoothly responding to the forces exerted from the three directions, both the right and the left, as well as from the up.

10 Claims, 14 Drawing Sheets

LEVER SWITCH AND METHOD OF OPERATING THE SAME

FIELD OF THE INVENTION

The present invention relates to a lever switch for use in various electronic appliances, and method of operating the switch.

BACKGROUND OF THE INVENTION

A conventional lever switch of the category is shown in FIG. 13, a cross sectional front view, and FIG. 14, an exploded perspective view. A resin case 1 is shaped in the form of a box with the top face open. The opposing sidewalls are provided with a round hole 1A, 1B at the upper part in a side portion. On the inner bottom surface, a common contact point 2 having a long size and an individual contact point 3 having a short size are provided. Each of the contact points 2, 3 has its respective terminal 2A, 3A provided at the outside of case 1.

A movable contact element 4 made of an elastic thin metal sheet comprises a flexed portion 4D bent in the shape of a character U in the middle, a fixed end 4A in one end and a contact portion, which is split into two contact points 4B, 4C, in the other end. The contact point 4B is normally having an elastic contact on the common contact point 2 disposed on the bottom surface of resin case 1, whereas the contact point 4C is positioned on the bottom resin surface at a place on the extension of short-sized individual contact point 3.

A resin lever 5 has in one end a rotation axis 5A, 5B to be fitting rotatably with the hole 1A, 1B and a protrusion 5C which is to have contact with the fixed end 4A; in the other end are an operating portion 5D protruding upward and a contact portion 5E which is to make contact with the upper surface of flexed portion 4D. The contact portion 5E is normally pushed up by the elastic force of the movable contact element 4 to be held at a certain position.

The operation of a lever switch having the above-described structure is described below. Shown in FIG. 13 is the lever switch in OFF state. When the operating portion 5D is pressed to the state of FIG. 15, a cross sectional view, the lever 5 rotates around the rotation axis 5A, 5B to push down and bend the flexed portion 4D. As a result, the contact portion 4B, 4C slides to the direction as indicated with a character X, until the contact portion 4C makes contact with the short-sized individual contact point 3. Thus the common contact point 2 and the individual contact point 3, or the terminal 2A and the terminal 3A, are electrically connected. The switch is brought to ON state. In the state of FIG. 15, as soon as the force pushing the operating portion 5D down is withdrawn the lever 5 is pushed back by the elastic restorative force of movable contact element 4. The switch returns to the OFF state as shown in FIG. 13.

The conventional lever switch smoothly responds to an action of pressing the lever 5 from the up and to a force exerted to the lever from the left as indicated by an arrow mark with a character Y in FIG. 13. However, the switch is not friendly to an operation from the right side. In view of the increasingly complicated function of the recent electronic appliances, there is a strong need for a lever switch that smoothly responds to the operating forces from both the right and the left as well as to the pressing action from the up.

SUMMARY OF THE INVENTION

The present invention addresses the above tasks and presents a lever switch that can be operated smoothly in both directions, the right and the left, as well as an operation from the up.

A lever switch in accordance with the present invention comprises a box-shaped case with the top face open, fixed contact points provided on the inner bottom surface of the case, a movable contact element of approximately reverse isosceles triangle shape in the side view, the equilateral sides forming two elastic feet are extending downward to cross and being provided with an elastic contact point for making contact with said fixed contact points at the tip end of respective two elastic feet, and an actuating body, the upper portion of which forming an operation lever and the bottom surface pressing the upper surface of the movable contact element at both corners.

With the above-described structure, the operation lever may be operated smoothly from the right, from the left, as well as from the up.

In an invented lever switch, it is preferred that the actuating body has an approximately isosceles triangle shape in the side view, and is provided with a protrusion in the bottom at a place making contact with the upper surface of the both corners of the movable contact element. The above-described actuating body ensures a smoother switching operation.

It is preferred that a cover has a long opening which allows the operation lever to come up through, and the actuating body is provided with a side ridge of the straight-line form on both sides at a place close to the bottom so as it is blocked by an edge of the long opening of the cover. Under such structure, the actuating body is supported stable being pressed down by the cover, and a gap existing between the long opening and the operation lever is kept closed. Thus a switch is provided with a good anti-dust property.

It is also preferred to provide a cam between the movable contact element and the actuating body for pushing the movable contact element on the upper surface at both corners, and to provide the actuating body on the sides with an axis portion for supporting the rotational motion at a middle point close to the bottom, the actuating body pressing the upper surface of movable contact element via the cam. Under the above-described structure, the switching operation becomes much smoother, also it becomes easy to control the deformation quantity of the movable contact element to be caused by operations from the right and left within a certain specific range.

It is also preferred that the axis portion of the actuating body has a round shape and the case is provided in the inner surface of side wall with a groove extending downward taking the form of a character U, which is to be engaged with the axis portion. The above structure facilitates a stable operation to respond to a pressing force from the up.

BRIEF DESCRIPTION OF THE DRAWINGS

FIG. 3(*b*) is a cross sectional front view of the lever switch being pushed from the up.

FIG. 11(*b*) is a front view of the lever switch having a different terminal layout.

DESCRIPTION OF THE PREFERRED EMBODIMENTS (Embodiment 1)

Figure 1:
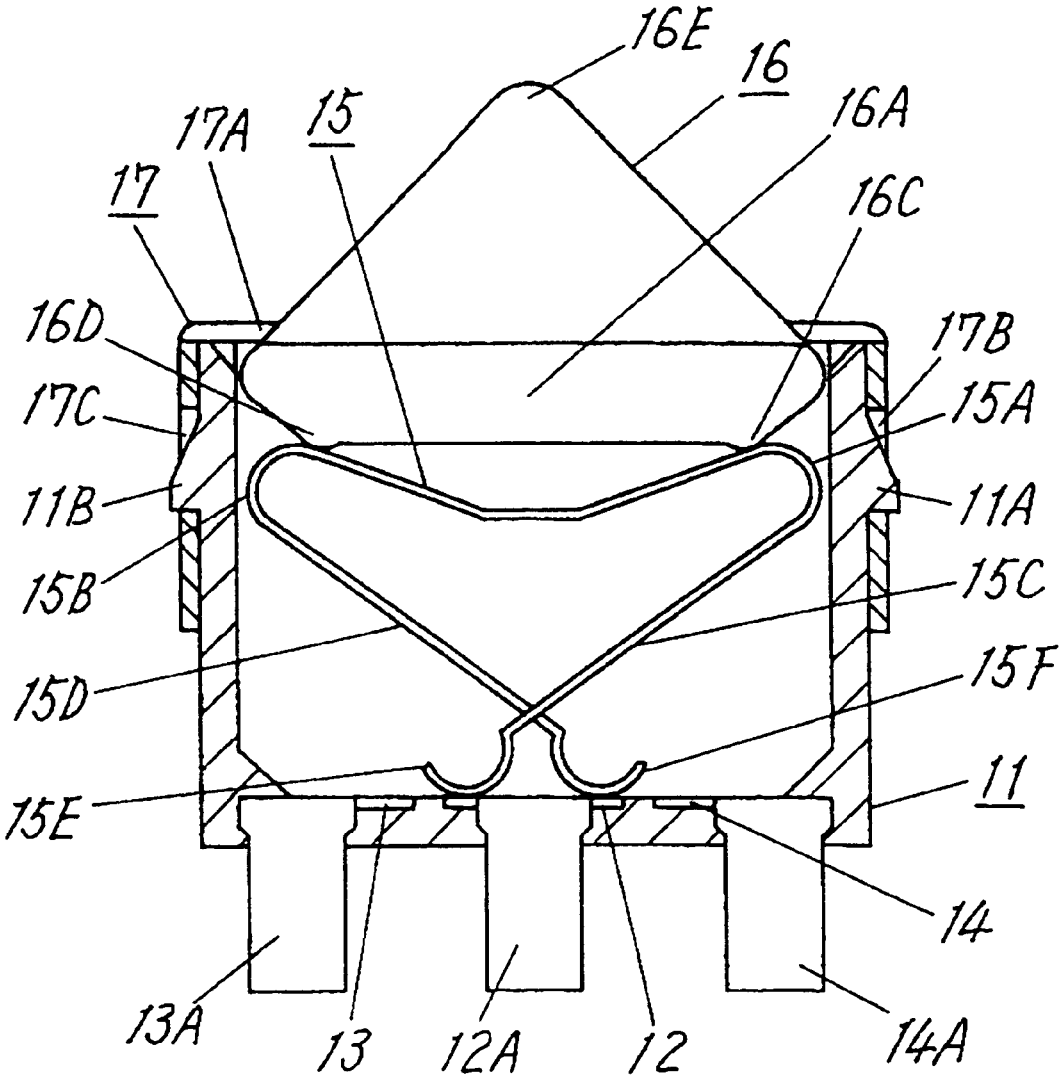
FIG. 1 is a cross sectional front view of a lever switch in accordance with first exemplary embodiment of the present invention.
Figure 2:
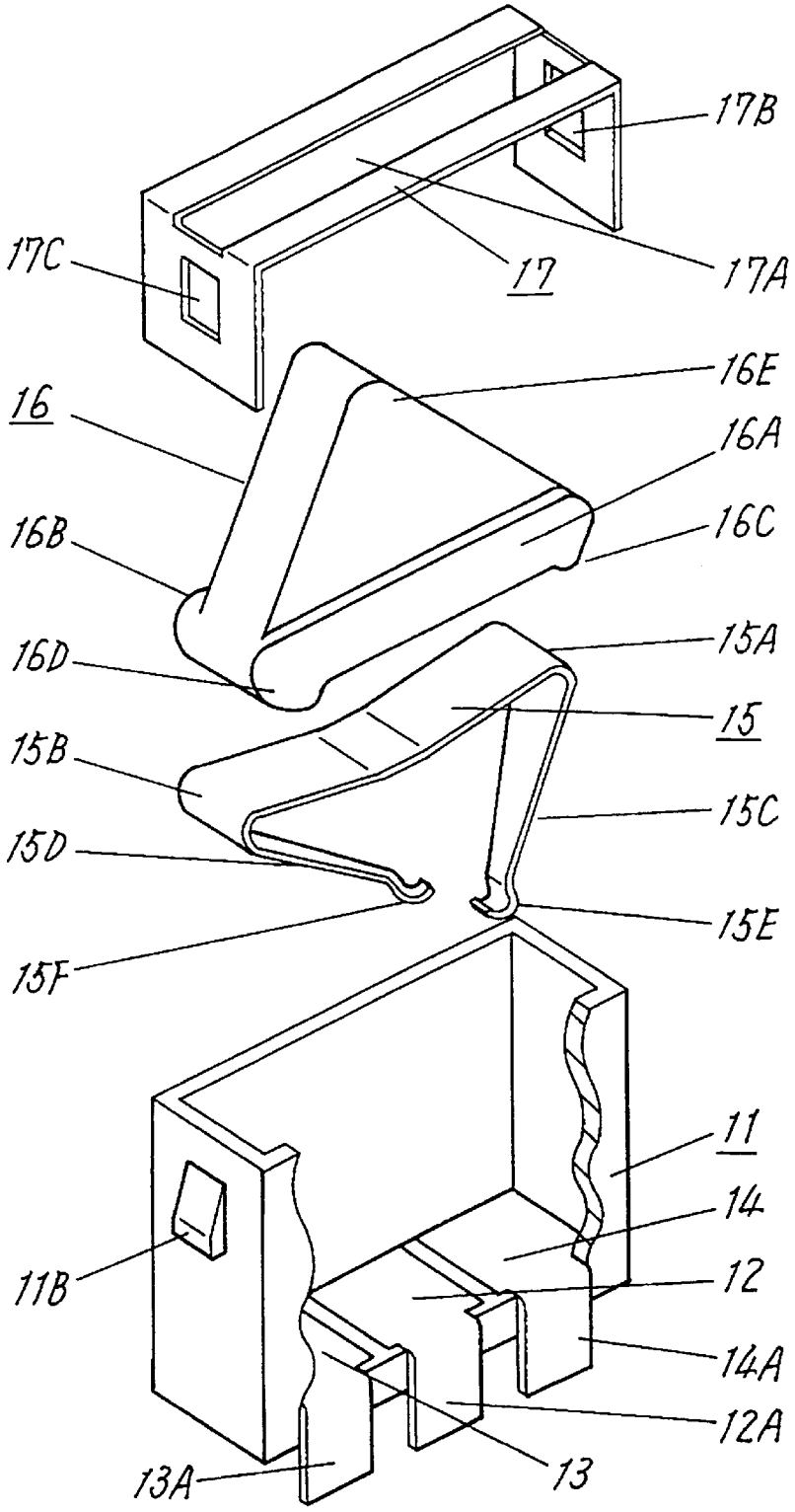
FIG. 2 is an exploded perspective view of the lever switch of FIG. 1.

As shown in FIG. 1 and FIG. 2, a lever switch in accordance with first exemplary embodiment of the present invention comprises a resin case 11 shaped in, when viewed from the top, the form of an oblong rectangular box with the top opened, which case being provided with a hooking protrusion 11A, 11B respectively on the outer surface of the right and left side walls. On the inner bottom surface, a common contact point 12 is provided in the middle, and individual contact points 13, 14 are provided at both sides with a certain gap provided from the common contact point 12 for the purpose of insulation. The respective contact points are provided with terminals 12A, 13A and 14A disposed outside the case 11.

A movable contact element 15 is made by punching and bending an elastic thin metal sheet, formed into an approximately reverse isosceles triangle having a flexed portion 15A, 15B of U-shape at the two corners, two elastic feet 15C, 15D are extending from the equilateral sides to be crossing at a low point. An elastic contact point 15E, 15F is provided at the tip end of the respective elastic feet 15C, 15D. In the normal state, both of the elastic contact points 15E, 15F are resting on the common contact point 12 with elasticity.

A resin-made actuating body 16 disposed on the top of the movable contact element 15 has an approximately isosceles triangle shape, which body is provided with a straight line side ridge 16A, 16B on both (in terms of the thickness direction) surfaces, running at the bottom portion in parallel with the bottom side connecting the bottom corners. A downward protrusion 16C, 16D provided at the vicinity of the bottom corners makes contact with the upper surface of the flexed portion 15A, 15B The middle top portion of actuating body 16 protrudes out of the opening of case 11 to become an operation lever 16E.

A cover 17 made of metal plate and shaped in the form of a symbol [ is disposed to cover the case 11 from the top. The cover 17 is provided with an oblong opening 17A in the middle of the width direction for allowing the operation lever 16E to come out through, also a small opening 17B, 17C is provided at both ends to be engaged with the hooking protrusion 11A, 11B at the upper part of both side walls for fixing. The actuating body 16 is pressed down at the side ridge 16A, 16B by the side rim of oblong opening 17A; as a result, the movable contact element 15 presses and bends the two elastic feet 15C, 15D and the elastic contact points 15E, 15F provided at the tip end press the inner bottom surface of case 11 with a certain elastic force. In the normal state, both of the elastic contact points 15E, 15F are resting in contact with the common contact point 12, creating OFF state as shown in FIG. 1.

Figure 3:
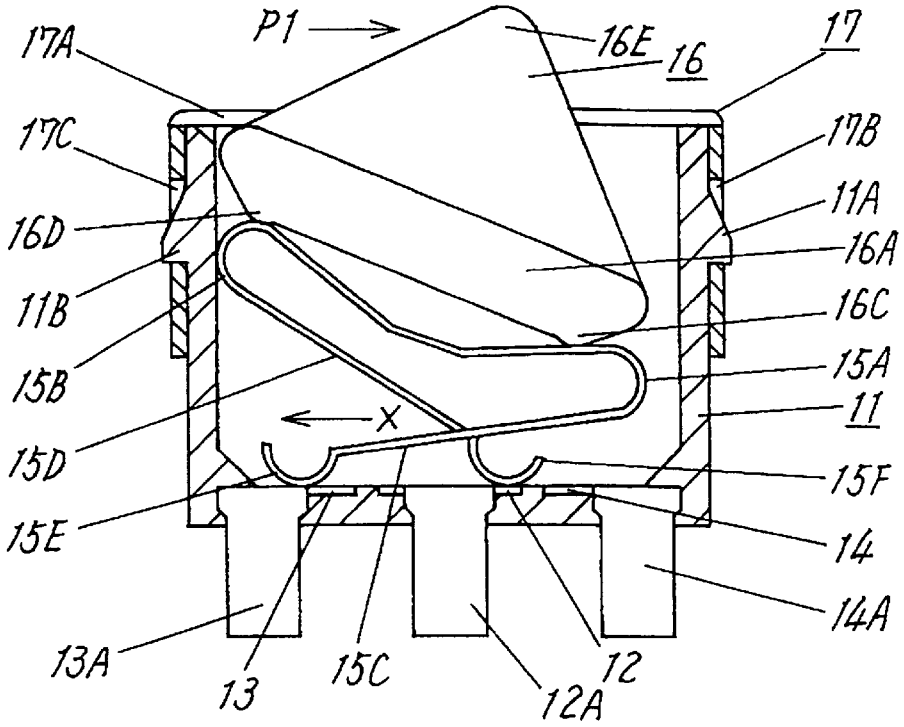
FIG. 3(*a*) is a cross sectional front view of the lever switch of FIG. 1, with the operating portion being pushed from the left.
Figure 3:
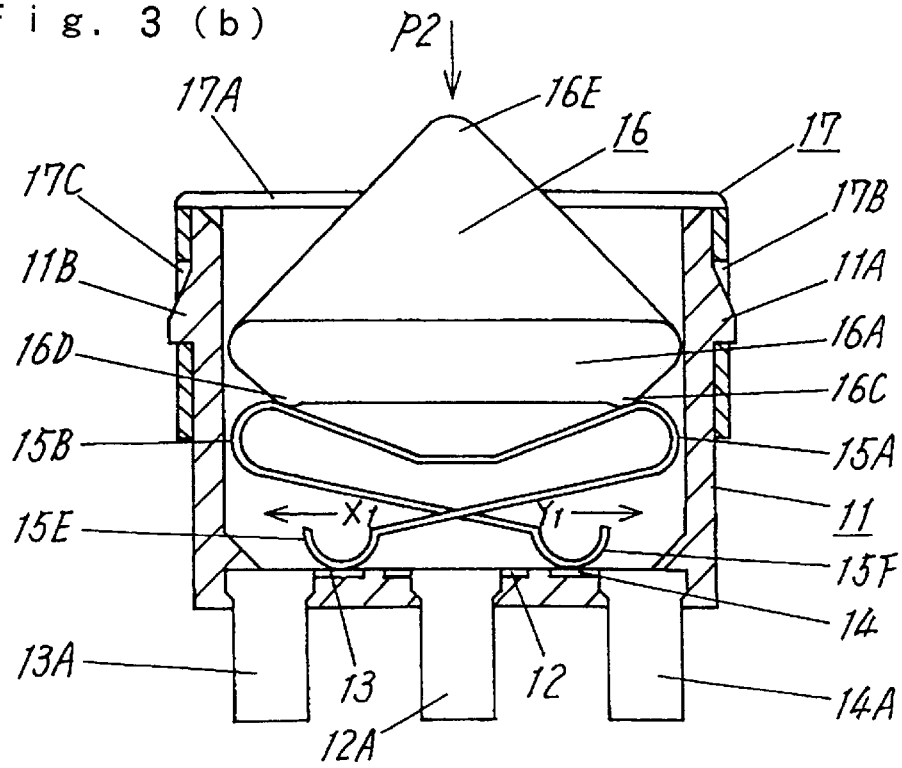

The operation of a lever switch under the above structure is described below. When the operation lever 16E appearing out of the oblong opening 17A, as shown in FIG. 1, is pushed from the left to the direction as indicated with an arrow mark P1 to create a state as shown in FIG. 3(*a*), the actuating body 16 makes a rotating motion with the left end of the side ridge 16A, 16B as the fulcrum, and the protrusion 16C pushes the flexed portion 15A down. As a result, the flexed portion 15A is compressed and bent, and the elastic contact point 15E slides on the surface of inner bottom in the direction indicated with an arrow mark X shown in FIG. 3(*a*). The elastic contact point 15E leaves the common contact point 12 to make an elastic contact with the individual contact point 13. The other elastic contact point 15F keeps staying on the common contact point 12; therefore, the common contact point 12 and the individual contact point 13, or the terminal 12A and the terminal 13A, are electrically connected to create ON state.

As soon as the pressure against operation lever 16E in the state of FIG. 3(*a*) is lifted, the actuating body 16 is pushed back upward by the elastic restorative force of movable contact element 15, and the elastic contact point 15E leaves the individual contact point 13 to go back to the common contact point 12. The switch returns to the OFF state as shown in FIG. 1.

Contrary to the above, when the operation lever 16E as shown in FIG. 1 is pressed from the right, the actuating body 16 makes a rotating motion with the right end of the side ridge 16A, 16B as the fulcrum, and the protrusion 16D pushes the flexed portion 15B down. As a result, the elastic contact point 15F slides on the surface of inner bottom in the direction reverse to an arrow mark X shown in FIG. 3(*a*) to make an elastic contact with the individual contact point 14. The other elastic contact point 15E keeps staying on the common contact point 12; therefore, the common contact point 12 and the individual contact point 14, or the terminal 12A and the terminal 14A, are electrically connected to create another ON state with respect to other circuitry. As soon as the pressure against operation lever 16E is lifted, the actuating body 16 is pushed back upward by the elastic restorative force of movable contact element 15, and the elastic contact point 15F leaves the individual contact point 14 to go back to the common contact point 12. The switch returns to the initial state as shown in FIG. 1.

When the operation lever 16E as shown in FIG. 1 is pressed vertically as indicated with an arrow mark P2 to create a state as shown in FIG. 3(*b*), the flexed portions 15A, 15B having contact with the protrusions 16C, 16D are compressed and bent, and the entire movable contact element 15 is pushed down. The elastic contact point 15E slides to the direction indicated with an arrow mark X1, while the elastic contact point 15F slides to the direction indicated with an arrow mark Y1; making an elastic contact with the individual contact 13 and 14, respectively, to electrically connect the terminal 13A and terminal 14A. This brings a still other circuit to ON state, which circuit being different from those formed during the earlier described operations in the right and the left directions.

As soon as the pressure against operation lever 16E is lifted, the actuating body 16 is pushed back upward by the elastic restorative force of movable contact element 15 and both of the elastic contact points 15E and 15F go back to the common contact point 12. The switch returns to the initial state as shown in FIG. 1.

The common contact point 12 and the respective individual contact points 13, 14 have been disposed with a certain distance in between for the purpose of insulation. Therefore, the elastic contact point 15E, 15F never makes contact with the common contact point 12 and the individual contact point 13, 14 at a same time.

In a lever switch in accordance with the present embodiment 1, the movable contact element 15, which is easy to make and inexpensive yet has a stable performance, provides the elastic contact point 15E, 15F with a stable contact pressure, also holds the actuating body 16 at a position in a stable manner. The operation lever 16E can be operated smoothly responding to a pressure either from the right or the left direction as well as that from the up. The lever switch is a quite useful one for use in electronic appliances of complicated functions because detects various actuating operations exerted from many directions. The movable contact element 15 is made of an elastic metal thin plate, through a simple punching and bending process using a press mould. This means that it is inexpensive, yet the performance is stable.

Figure 4:
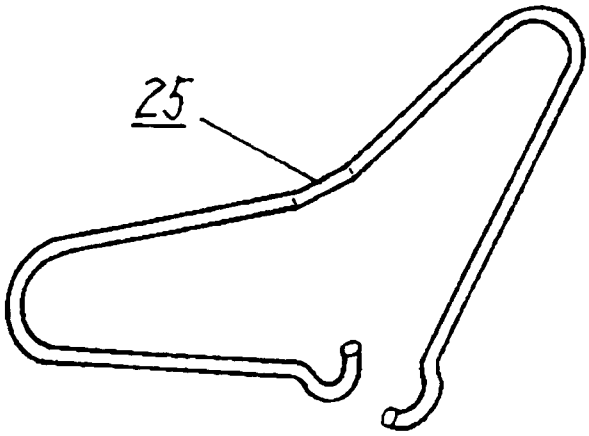
FIG. 4 is a perspective view showing other example of the movable contact element.

In place of the above-described movable contact element 15, which has been formed by an elastic metal thin plate, a movable contact element 25, as shown in a perspective view in FIG. 4, formed with an elastic metal wire, whose dimension in the direction of thickness is small, may be used instead. The thickness of the case 11 and the like items may be reduced as a result of the use of the movable contact element 25. The movable contact element 25 may be formed quickly at a lower cost, without using a mould.

Figure 5:
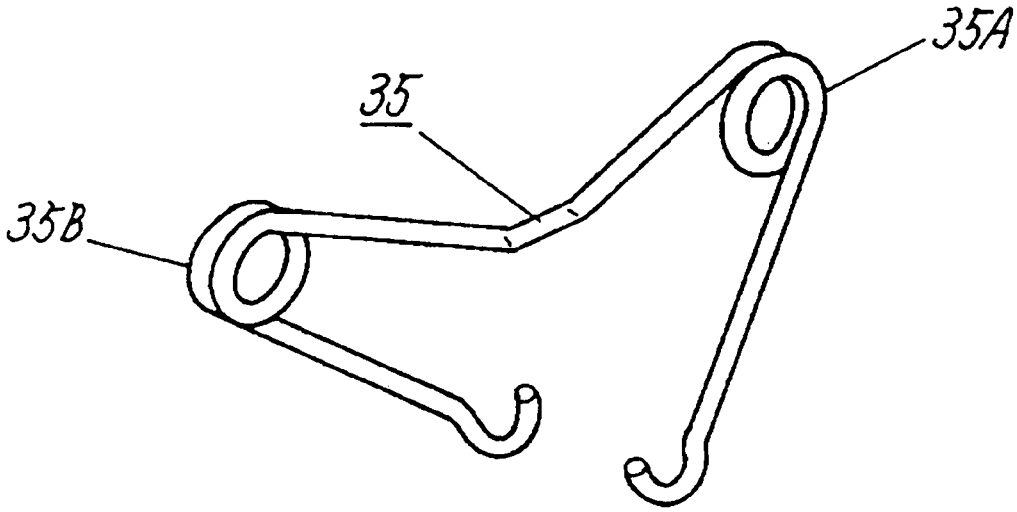
FIG. 5 is a perspective view showing still other example of the movable contact element.

Also, a movable contact element 35 as shown in a perspective view in FIG. 5 may be formed with an elastic metal wire by providing a coiled portion 35A, 35B at both of the corners. By so doing, the stress due to bending of the movable contact element 35 caused by a press of the operation lever 16E may be dispersed. This improves the operating life of the bending portion, and provides a room for increasing the operational stroke of operation lever 16E as well.

(Embodiment 2)

Figure 6:
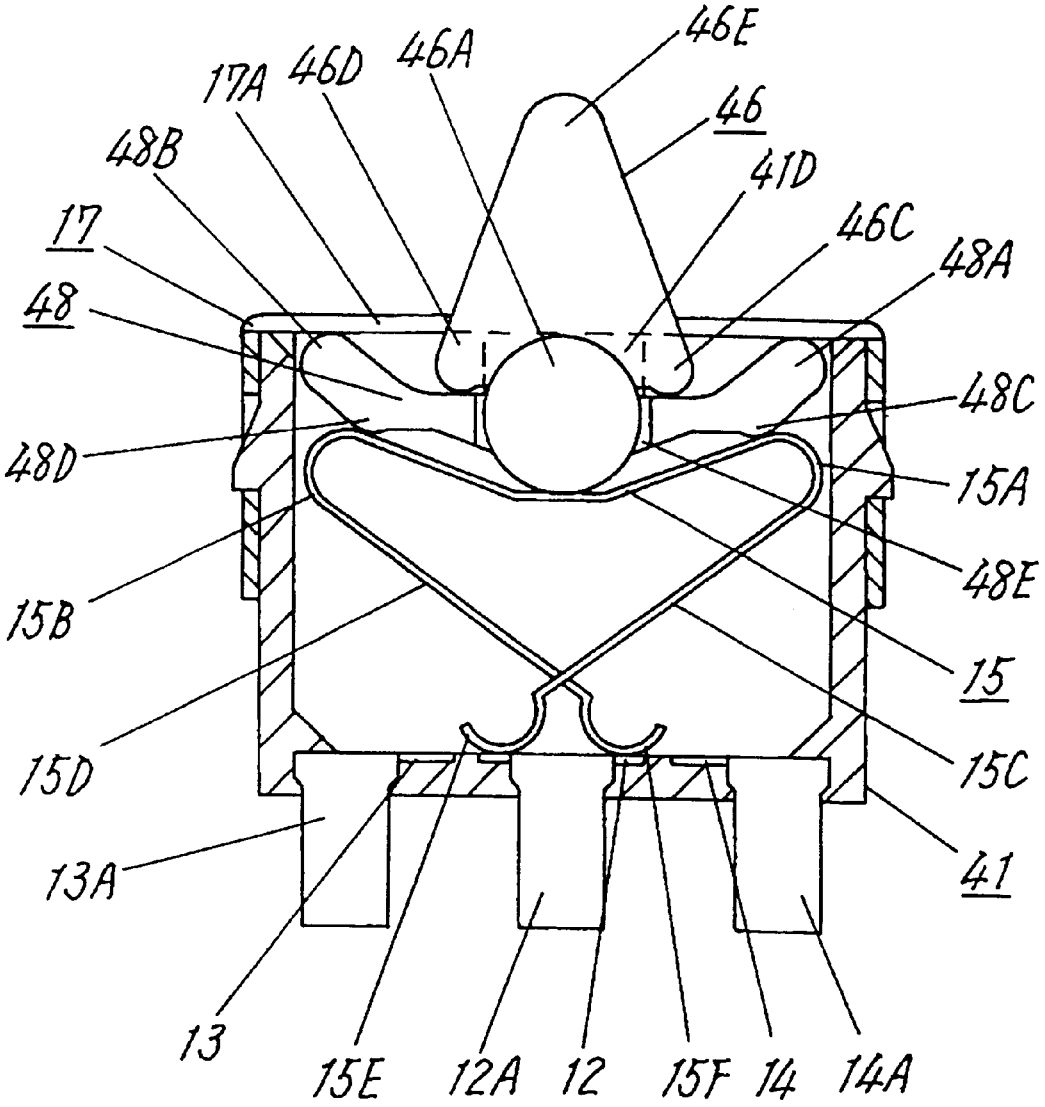
FIG. 6 is a cross sectional front view of a lever switch in accordance with second exemplary embodiment of the present invention.
Figure 7:
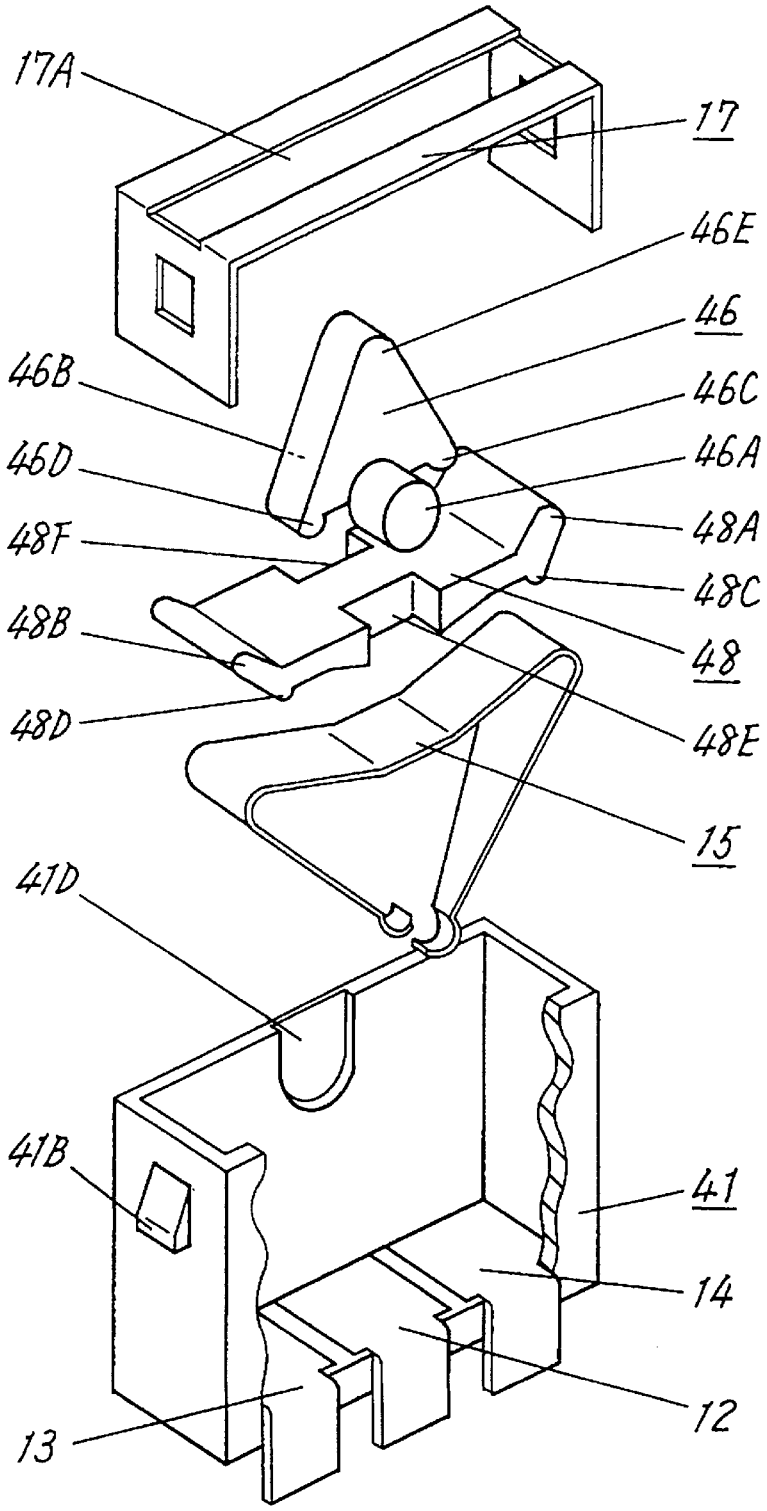
FIG. 7 is an exploded perspective view of the lever switch of FIG. 6.

A lever switch in accordance with second exemplary embodiment of the present invention as shown in FIG. 6 and FIG. 7 is different from that of embodiment 1 in that the former lever switch comprises a case 41 and an actuating body 46 of different shape, and further comprises a resin cam 48 provided between the bottom of actuating body 46 and the movable contact element 15.

The actuating body 46 is shaped in the form of an approximately isosceles triangle, the length of which bottom side is shorter than the distance between the two flexed portions 15A, 15B of the movable contact element 15. The actuating body 46 is provided with a round-shape axis portion 46A, 46B protruding at the bottom center to both directions of the thickness, as well as a protrusion 46C, 46D protruding downward at both ends of the bottom side. The case 41 is provided with a U-shape groove 41C, 41D of a certain specific length at the middle of the open end of the broader side-walls facing to each other. The U-shape grooves 41C, 41D rotatably support the round-shape axes 46A, 46B, respectively, of said actuating body 46.

The cam 48 is engaged at horn protrusion 48A, 48B provided at both ends with the inner edge of the length direction of case 41 to be movable in up-down direction. The cam 48 is provided also with a downward protrusion 48C, 48D at the vicinity of both ends for making contact with the upper surface of the movable contact element 15 at the respective two flexed portions 15A, 15B. The cam 48 is further provided in the middle with a cut 48E, 48F at both ends in the direction of thickness for allowing the round-shape axis 46A, 46B of actuating body 46. Like in the case of embodiment 1, the cover 17 allows the operation lever 46E of actuating body 46 to come out through oblong opening 17A, while it presses the upper portion of the round-shape axis 46A, 46B and the horn protrusion 48A, 48B down. The actuating body 46 and the cam 48 are pushed down to bend the two elastic feet 15C, 15D of movable contact element 15 placed thereunder. The two elastic contact points 15E, 15F are made to have contact with inner bottom surface of case 41 at a certain specific elastic force. In the normal stare, both of the elastic contact points 15E, 15F rest on the common contact point 12 creating OFF state as shown in FIG. 6.

Figure 8:
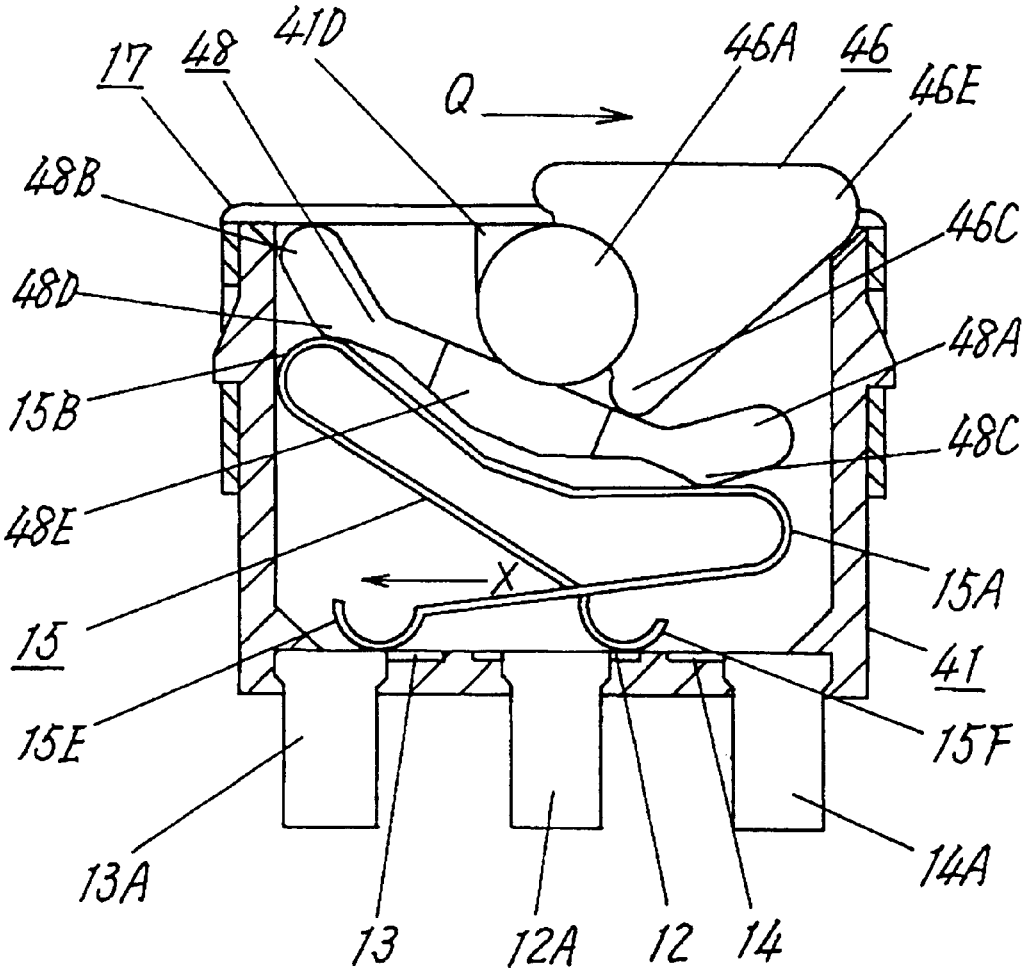
FIG. 8 is a cross sectional front view of the lever switch of FIG. 6, with the operating portion being pushed from the left.

The operation of a lever switch under the above structure is described below. When the operation lever 46E in the state of FIG. 6 is pressed from the left to the direction as indicated with an arrow mark Q to create a state as shown in FIG. 8, the actuating body 46 makes a rotating motion around the round-shape axis 46A, 46B and the protrusion 46C presses the upper surface of the cam 48 down. The pressed cam 48 makes a rotating motion with the horn protrusion 48B as the axis, and the flexed portion 15A having contact with the protrusion 48C goes down to bend the movable contact element 15. As a result, the elastic contact point 15E slides on the surface of inner bottom in the direction indicated with an arrow mark X shown in FIG. 8 to make an elastic contact with the individual contact point 13. The other elastic contact point 15F keeps staying on the common contact point 12; therefore, the common contact point 12 and the individual contact point 13, or the terminal 12A and the terminal 13A, are electrically connected to create ON state As soon as the pressure against operation lever 46E in the state of FIG. 8 is lifted, the cam 48 and the actuating body 46 are pushed back upward by the elastic restorative force of movable contact element 15, and the elastic contact point 15F goes back to the common contact point 12. The switch returns to the OFF state as shown in FIG. 6.

When the operation lever 46E is pushed from the right, the common contact point 12 is electrically connected to the individual contact point 14. Detailed description on the above operation is omitted because the principle remains the same as that when the operation lever is pushed from the left.

In a lever switch in accordance with the present embodiment 2, the actuating body 46 rotates at a fixed point to push the cam 48 down. Therefore, the operation lever 46E can respond smoothly to operational forces either from the right and the left directions. Furthermore, as the maximum quantity of the cam 48 going down by the press of the operation lever 46E is limited by the dimension from the round-shape axis 46A, 46B to the protrusion 46C or the protrusion 46D, it is easy to control the amount of deformation of the movable contact element 15 to be caused by the operations from the right and the left directions within a certain range.

Figure 9:
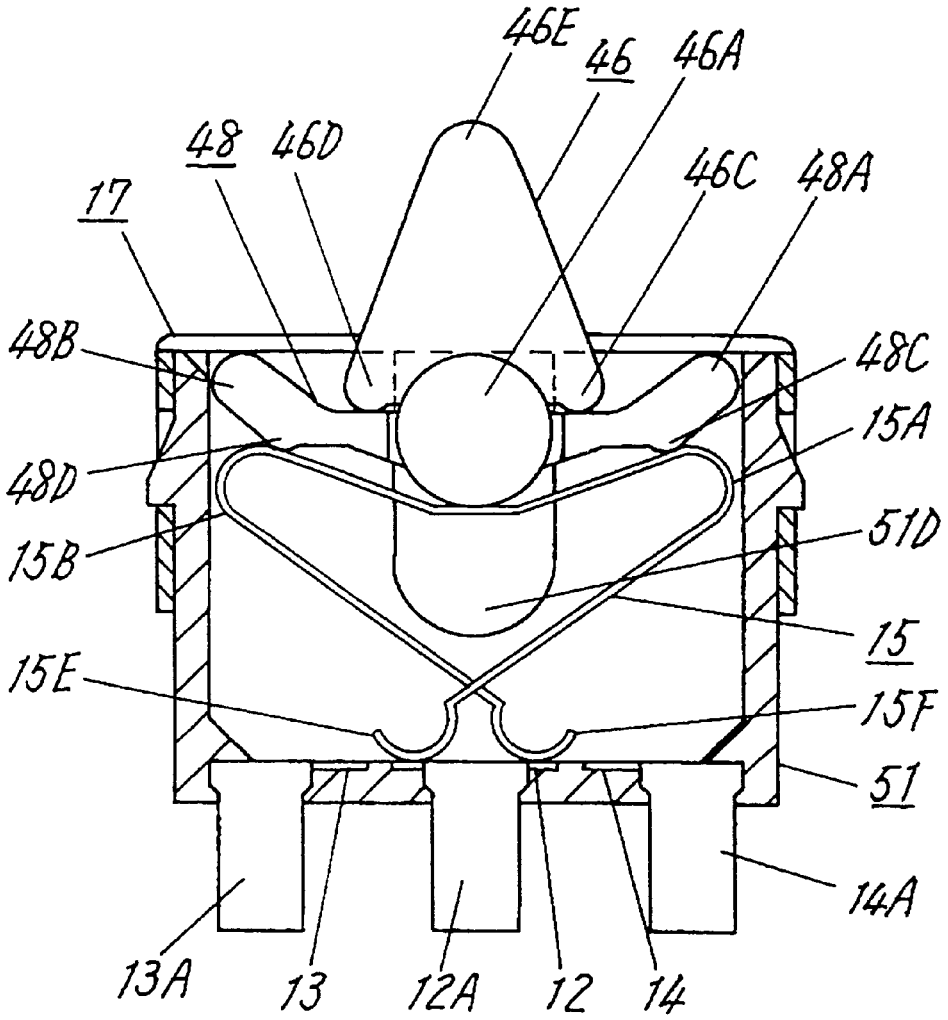
FIG. 9 is a cross sectional front view showing the lever switch of FIG. 6, with the U-shape groove of the sidewall extended down ward.
Figure 10:
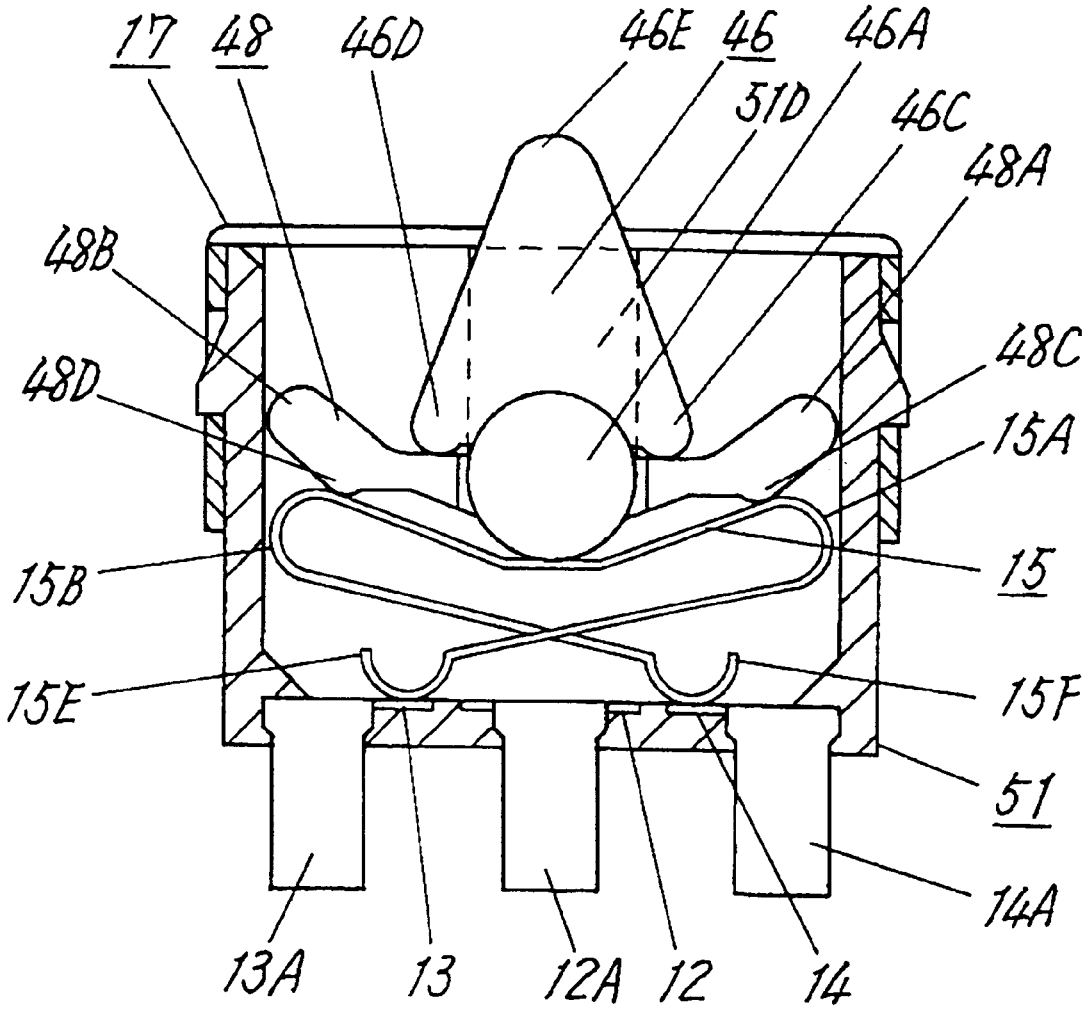
FIG. 10 is a cross sectional front view of the lever switch of FIG. 9, with the operating portion being pushed from the up.

The length of the U-shape groove 41C, 41D has been described in the above to be such that it can support the round-shape axis 46A, 46B rotatable. The length of U-shape groove may be extended downward so as to have longer parallel lines, as shown in FIG. 9 as 51C, 51D. By so doing, the lever switch can respond to a force applied vertically on the operation lever 46E from the up. In a lever switch of such a structure, the elastic contact points 15E, 15F slide on the inner bottom surface of the case 51 to have a connection, or disconnection, with the individual contact points 13, 14, as illustrated in FIG. 10. Thus a lever switch is presented that can respond smoothly to a vertical pressure, in addition to the pressures from the right and the left.

(Embodiment 3)

Figure 11:
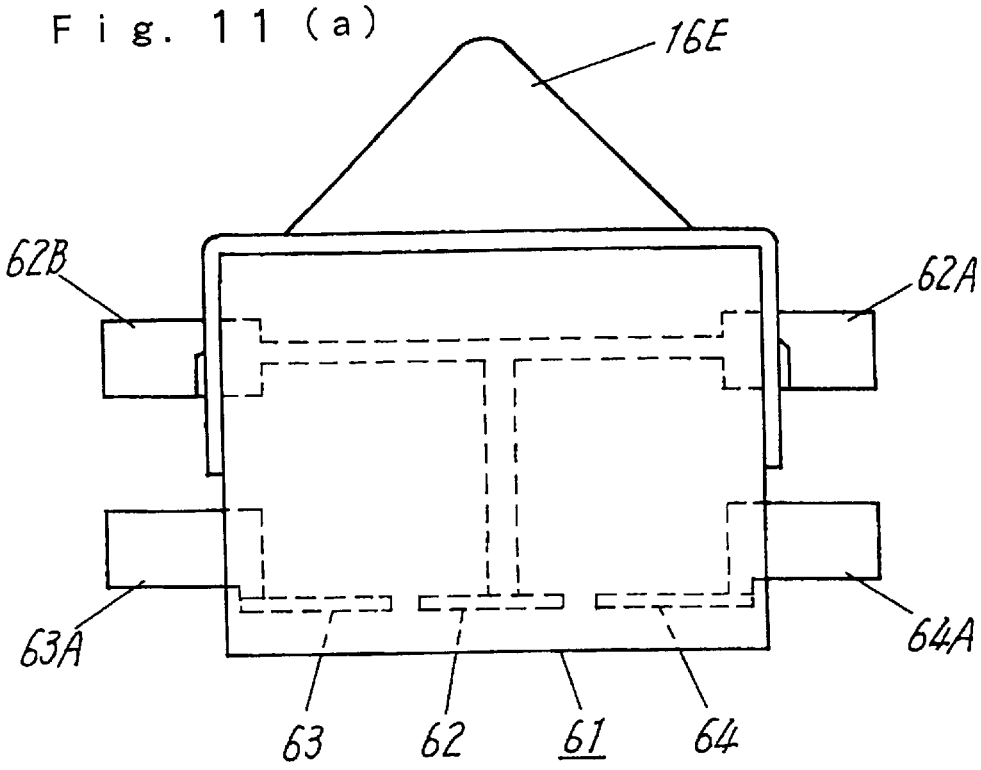
FIG. 11(*a*) is a front view of a lever switch in accordance with third exemplary embodiment of the present invention.
Figure 11:
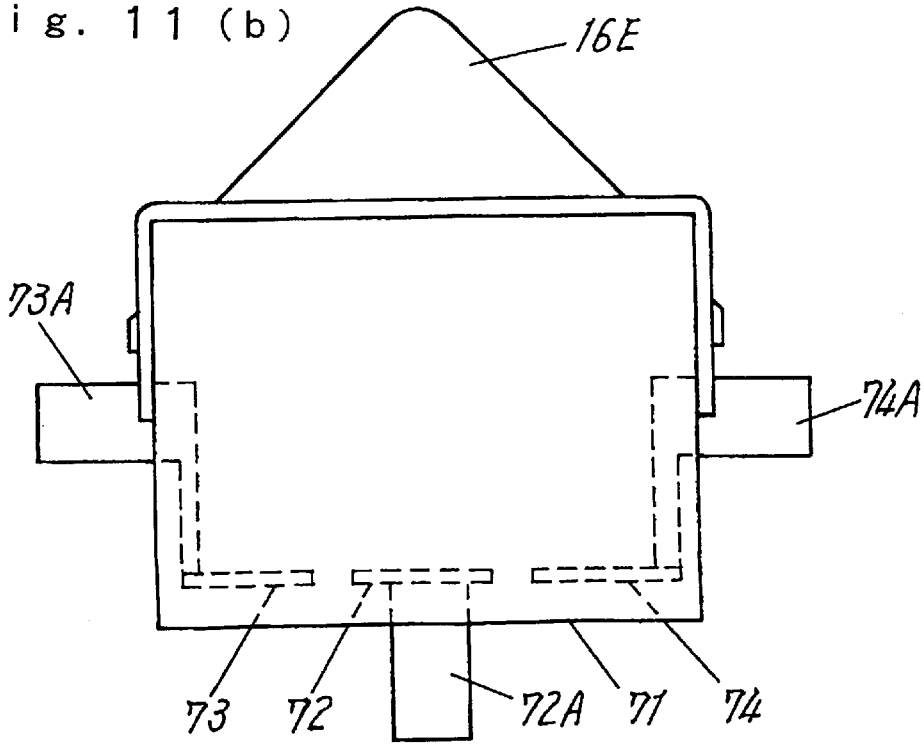
Figure 12A:
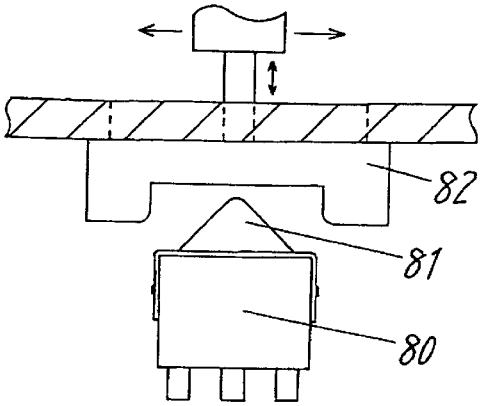
FIG. 12(*a*), FIG. 12(*b*), FIG. 12(*c*), FIG. 12(*d*) and FIG. 12(*e*) exemplify varieties of concepts how a lever switch is used as detection switch in accordance with fourth exemplary embodiment.
Figure 12B:
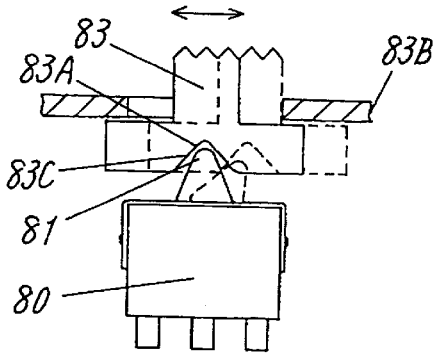
Figure 12C:
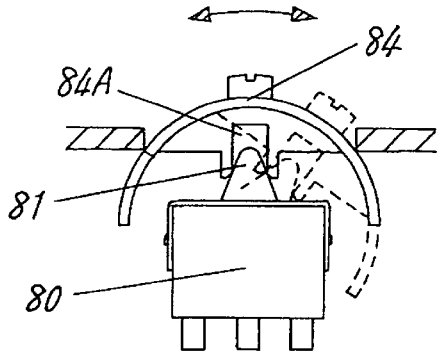
Figure 12D:
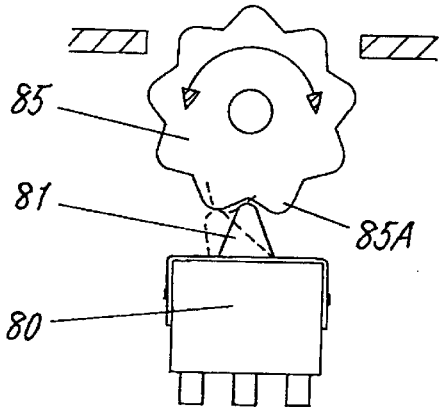
Figure 12E:
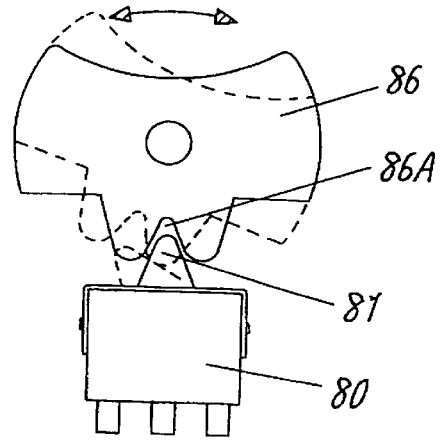
Figure 13:
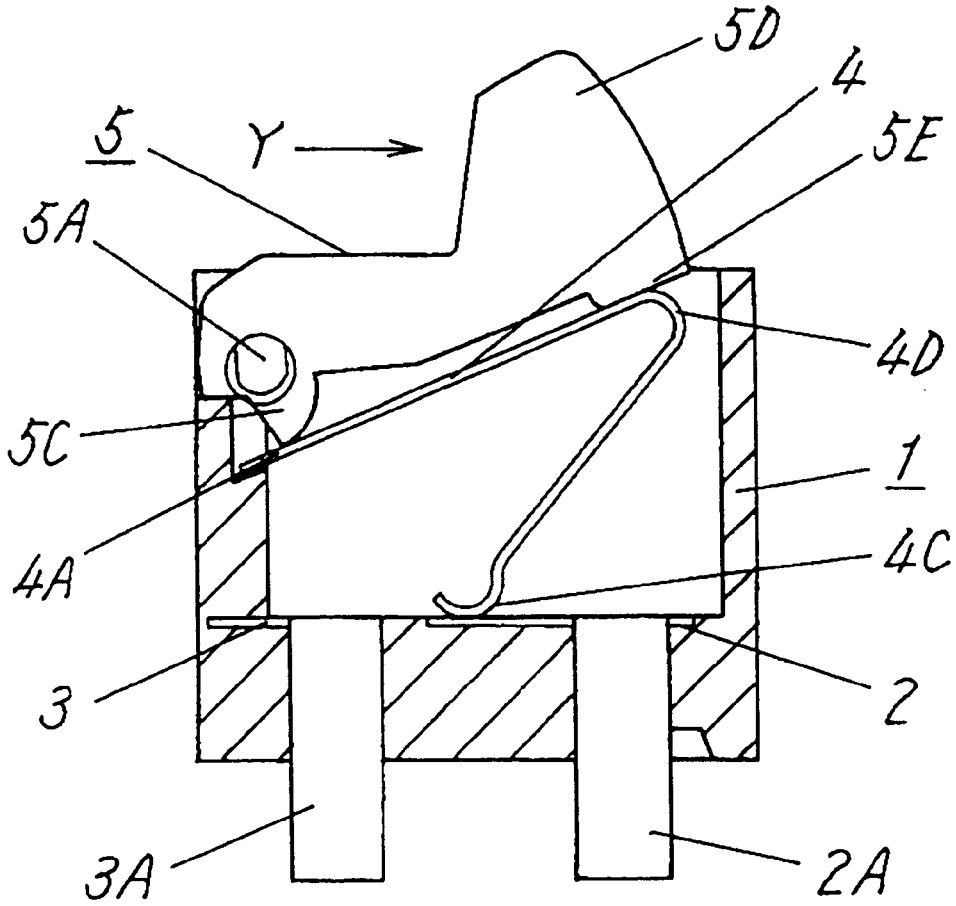
Fig. 13 PRIOR ART
FIG. 13 is a cross sectional front view of a conventional lever switch.
Figure 14:
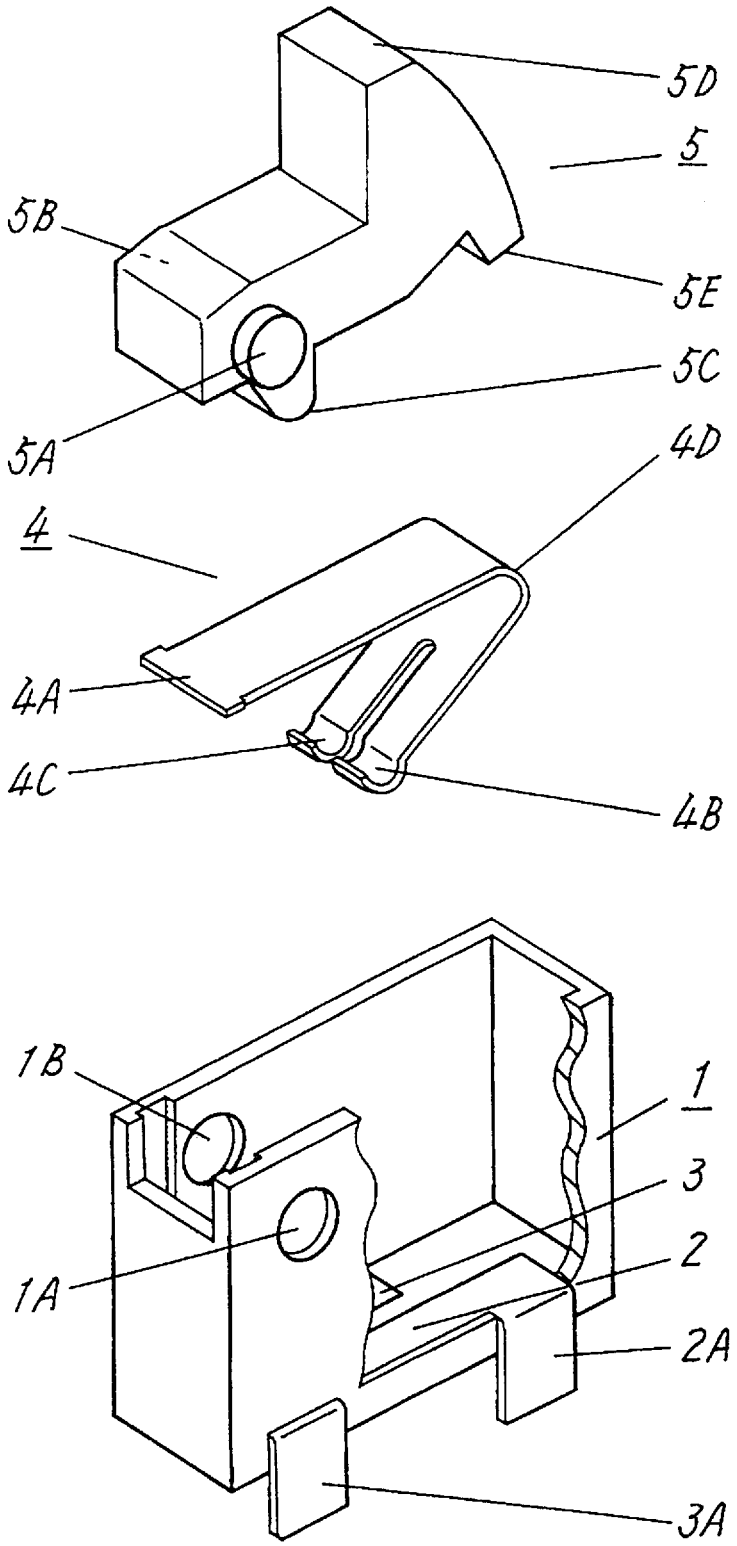
Fig. 14 PRIOR ART
FIG. 14 is an exploded perspective view of the lever switch of FIG. 13.
Figure 15:
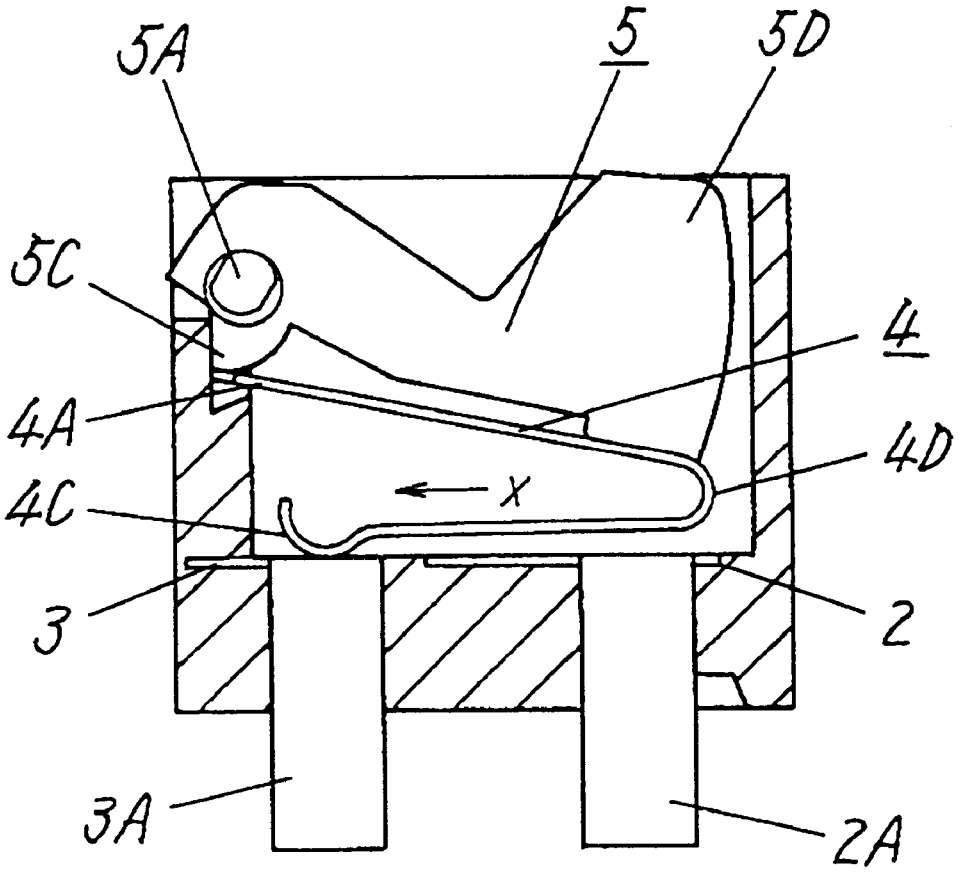
Fig. 15 PRIOR ART
FIG. 15 is a cross sectional front view of the lever switch of FIG. 13, with the operating portion being pushed.

A lever switch in accordance with third exemplary embodiment of the present invention as shown in FIG. 11(*a*) and FIG. 11(*b*) is different from those of embodiments 1 and 2 in the disposition of outer terminals pulled out of a case 61 or a case 71.

The outer terminals connected respectively to the common contact points 62, 72 and individual contact points 63, 64, 73, 74 being disposed on the inner bottom surface of case 61 or case 71 are provided at one of the broader pair walls locating face to face at both sides of an operation lever 16E to constitute the case. FIG. 11(*a*) shows an example, in which four outer terminals 62A, 62B, 63A, 64A are disposed at two opposing sides of the wall; FIG. 11(*b*) shows another example, in which three outer terminals 72A ,73A, 74A are disposed respectively at three sides, namely, the above-described two opposing sides plus a side opposite to the side from which the operation lever 16E has been emerging.

Each of the common contact point 62, 72, and the individual contact points 63, 64, 73, 74 is connected to the respective outer terminals along one of the broader pair walls, in a manner as indicated with broken lines in FIG. 11(*a*), FIG. 11(*b*). However, the method of connection and the way how the terminal is pulled out of a case are not limited to what have been illustrated above.

Thus the terminals 62A, 62B, 63A, 64A, 72A, 73A, 74A may be disposed split at the three sides of the case 61, 71, excluding the side from which the operation lever 16E is protruding. The lever switch having the above-described configuration may easily be mounted on a circuit board that is parallel to a plane from which the operation lever 16E is protruding. Disposing the outer terminals split in the surrounding sides of the case 61, 71 may contribute also to enhance the mounting strength when they are soldered with.

(Embodiment 4)

FIG. 12(*a*), FIG. 12(*b*), FIG. 12(*c*), FIG. 12(*d*), FIG. 12(*e*) represent the concepts of operating a lever switch in accordance with fourth exemplary embodiment of the present invention. In the drawings, numeral 80 denotes a lever switch in accordance with embodiment 1 or embodiment 2, numeral 81 is an operation lever thereof.

The structure and the operation are described below with reference to the respective drawings.

FIG. 12(*a*) illustrates a case in which a lever switch 80 has been installed within inside of an apparatus, and the operation lever 81 is pressed by an operation member 82 of the apparatus in the right, the left or the vertical direction. The direction of movement of the operation lever 81 is detected by the contact points of the lever switch. Thus the lever switch detects intricate operations of an apparatus in two or three directions.

FIG. 12(*b*) illustrates a case in which an operation knob 83 having at the bottom an engaging portion 83A for engagement with the operation lever 81 of a lever switch 80 makes a sliding motion right and left guided by a guide 83B of an apparatus. The operation lever 81 moves right or left pushed by a wall surface 83C of the engaging portion 83A. As soon as the force exerted to the operation knob 83 is lifted, the operation knob 83 is returned to the neutral position by the self restorative force of the operation lever 81. Thus a lever switch 80 can be used as a slide switch that normally returns to the neutral position.

FIG. 12(*c*) illustrates a case in which an operation knob 84 has been provided in an apparatus to be rotatable for a certain angle range. The operation knob 84 comprises at the bottom surface an engaging portion 84A, which portion is coupled with the operation lever 81 of a lever switch 80 being disposed with the center and that of the operation knob 84 on a same straight line. When the operation knob 84 is rotated to the right or the left direction, the operation lever 81 also follows in the direction. As soon as the force exerted to the operation knob 84 is lifted, the operation knob 84 is returned to the neutral position by the self restorative force of the operation lever 81. Thus a lever switch 80 can be used as a rotary switch that normally returns to the neutral position.

FIG. 12(*d*) illustrates a case in which an operation knob 85 of a toothed wheel shape having an indent/protrusion portion 85A around the entire circumference has been rotatably provided in an apparatus. The indent/protrusion portion 85A is engaged with the tip end of operation lever 81 of a lever switch 80, which has been disposed with the center and that of the operation knob 85 on a same straight line. When the operation knob 85 is rotated to the right or the left direction, the operation lever 81 is pushed by a protrusion in the circumference of the operation knob and moves accordingly. When an indent in the outer circumference of the operation knob 85 comes on the center line position, the operation lever 81 returns to the neutral position by the self restorative force. By a further rotation of the operation knob 85 in the same direction, the operation lever 81 is pushed by the next protrusion of the operation knob 85 and moves to the same direction. When the operation knob 85 is rotated in the reverse direction, the operation lever 81 likewise repeats the same action in the same reverse direction. Thus a lever switch 80 can be used as a rotary encoder that generates pulse signals with other contact point when direction of the rotation is reversed.

FIG. 12(*e*) illustrates a case in which an operation knob 86 has been provided so as to be able to move like a seesaw on an apparatus. An engaging portion 86A provided under the center of seesaw action of the operation knob 86 is engaged with the tip end of operation lever 81 of a lever switch 80, which has been disposed with the center and that of the operation knob 86 on a same straight line. When the operation knob 86 is provided with a motion in the right or the left direction, the operation lever 81 moves to the left or the right direction pushed by the engaging portion 86A. As soon as the force exerted on the operation knob 86 is lifted, the operation knob 86 is returned to the neutral position by the self restorative force of the operation lever 81. Thus a lever switch 80 can be used as a seesaw switch that normally returns to the neutral position.

In accordance with the above exemplary cases of the present embodiment, a lever switch 80 may be operated by an operation member 82 for detecting the operating direction of the operation member 82. Or, by providing an operation knob 83, 84, 85 or 86 that matches the operation lever 81 of a lever switch 80, the lever switch 80 may be operated through varieties of operating modes; sliding, rotating, rotating or swaying, etc.

What is claimed is:

1. A lever switch comprising:

a box-shaped case with a top face open:

fixed contact points provided on an inner bottom surface of said case;

a movable contact element of approximately reverse isosceles triangle shape in a side view, having two elastic feet which extend downward to cross, each of said two elastic feet having an elastic contact point at a tip end thereof for making contact with said fixed contact points;

an actuating body having a bottom surface pressing an upper surface of said movable contact element at both corners and an upper portion forming an operation lever; and a cover having an opening for allowing said operation lever to come out.

2. The lever switch of claim 1, wherein said actuating body has an approximately isosceles triangle shape in a side view and is provided with a protrusion in the bottom surface for making contact with said movable contact element at both corners.

3. The lever switch of claim 2, wherein said opening is oblong, and said actuating body is provided with a ridge of straight-line form on both sides in a place close to the bottom surface so as it is blocked by a side rim of the oblong opening.

4. The lever switch of claim 1, further comprising a cam disposed between said movable contact element and said actuating body, said cam having a bottom surface pressing the upper surface of said movable contact element at both corners, wherein said actuating body has an approximately isosceles triangle shape in a side view, and is provided with an axis portion on sides in a middle close to the bottom surface to be functioning as a fulcrum for rotating motion, and said actuating body presses the upper surface of said movable contact element via said cam.

5. The lever switch of claim 4, wherein said cam is provided on the bottom surface with a protrusion for making contact with said movable contact element at both corners, and said protrusion pushes the upper surface of said movable contact element.

6. The lever switch of claim 4, wherein said axis portion has a round shape, and said case is provided in an inner surface of side-wall with a groove extending downward taking the form of a character U for supporting said axis portion.

7. The lever switch of claim 1, wherein said movable contact element comprises an elastic metal sheet.

8. The lever switch of claim 1, wherein said movable contact element comprises an elastic metal wire.

9. The lever switch of claim 8, wherein flexed portions of said movable contact element bridging the upper surface and the elastic feet are formed in a coil shape.

10. The lever switch of claim 1, wherein said fixed contact points comprises a common contact point provided in a middle of the inner bottom surface and individual contact points provided in both sides of said common contact point, said common contact point and said individual contact points have their respective outer terminals for leading signals out, and said outer terminals are provided protruding from at least one among three sides of a side-wall of said case.

* * * * *